US009661968B2

(12) United States Patent
Bradbury

(10) Patent No.: US 9,661,968 B2
(45) **Date of Patent: *May 30, 2017**

(54) FLOOR CLEANING DEVICE HAVING DISPOSABLE FLOOR SHEETS AND ROTATABLE BEATER BAR AND METHOD OF CLEANING A FLOOR THEREWITH

(71) Applicant: The Procter & Gamble Company, Cincinnati, OH (US)

(72) Inventor: Glenn Allen Bradbury, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/172,290

(22) Filed: Jun. 3, 2016

(65) Prior Publication Data

US 2016/0278594 A1 Sep. 29, 2016

Related U.S. Application Data

(63) Continuation of application No. 14/537,924, filed on Nov. 11, 2014, now Pat. No. 9,468,347, which is a (Continued)

(51) Int. Cl.

| | |
|---|---|
| ***A47L 11/33*** | (2006.01) |
| ***A47L 13/16*** | (2006.01) |
| ***A47L 13/20*** | (2006.01) |
| ***A47L 13/52*** | (2006.01) |
| ***A47L 9/04*** | (2006.01) |

(Continued)

(52) U.S. Cl.

CPC ..... *A47L 9/0422* (2013.01); *A47L 9/0483* (2013.01); *A47L 9/0686* (2013.01); *A47L 9/1409* (2013.01); *A47L 11/22* (2013.01); *A47L 11/33* (2013.01); *A47L 11/4013* (2013.01); *A47L 11/4041* (2013.01); *A47L 11/4069* (2013.01); *A47L 11/4072* (2013.01); *A47L 13/12* (2013.01); *A47L 13/16* (2013.01); *A47L 13/20* (2013.01); *A47L 13/44* (2013.01); *A47L 13/52* (2013.01)

(58) Field of Classification Search

CPC ..... A47L 11/33; A47L 13/16; A47L 13/20; A47L 13/44; A47L 13/52

See application file for complete search history.

(56) References Cited

U.S. PATENT DOCUMENTS

| | | | |
|---|---|---|---|
| 9,783 | A | 6/1853 | Pusey |
| 306,008 | A | 9/1884 | Drew |

(Continued)

FOREIGN PATENT DOCUMENTS

| | | | |
|---|---|---|---|
| AU | 671431 | B2 | 8/1996 |
| CN | 2180195 | Y | 10/1994 |

(Continued)

*Primary Examiner* — Randall Chin

(74) *Attorney, Agent, or Firm* — Larry L. Huston; Steven W. Miller

(57) ABSTRACT

A cleaning system. The system has a floor cleaning device, disposable floor sheet removably attachable to the device pad, and a rotatable beater bar. The device has a single wheel, and moves on the target surface by rolling action of the wheel and gliding of the floor sheet. This arrangement, not having multiple wheels, provides enhanced maneuverability, and improves cleaning performance. The cleaning system may be used to clean hard surfaces, such as a floor.

20 Claims, 7 Drawing Sheets

Related U.S. Application Data continuation-in-part of application No. 13/947,501, filed on Jul. 22, 2013, now Pat. No. 9,408,518, and a continuation of application No. 13/524,491, filed on Jun. 15, 2012, now Pat. No. 8,910,340.

(51) Int. Cl.

| | |
|---|---|
| ***A47L 13/44*** | (2006.01) |
| ***A47L 11/40*** | (2006.01) |
| ***A47L 13/12*** | (2006.01) |
| ***A47L 9/06*** | (2006.01) |
| ***A47L 9/14*** | (2006.01) |
| ***A47L 11/22*** | (2006.01) |

(56) References Cited

U.S. PATENT DOCUMENTS

| | | | |
|---|---|---|---|
| 329,257 | A | 10/1885 | Bissell |
| 1,725,762 | A | 8/1929 | Lee |
| 2,178,917 | A | 11/1939 | Pullen |
| 3,034,165 | A | 5/1962 | Christian |
| 4,191,609 | A | 3/1980 | Trokhan |
| 4,369,539 | A | 1/1983 | Nordeen |
| 4,637,859 | A | 1/1987 | Trokhan |
| 4,654,927 | A | 4/1987 | Novinger |
| 4,701,969 | A | 10/1987 | Berfield et al. |
| 4,709,436 | A | 12/1987 | Berfield et al. |
| 5,208,935 | A | 5/1993 | Jailor et al. |
| 5,461,749 | A | 10/1995 | Ahlberg et al. |
| 5,539,953 | A | 7/1996 | Kurz |
| 5,655,250 | A | 8/1997 | Warrell |
| 5,901,411 | A | 5/1999 | Hato et al. |
| 5,960,508 | A | 10/1999 | Holt et al. |
| 6,048,368 | A | 4/2000 | Tcheou et al. |
| 6,101,661 | A | 8/2000 | Policicchio et al. |
| 6,305,046 | B1 | 10/2001 | Kingry et al. |
| 6,386,392 | B1 | 5/2002 | Bradbury et al. |
| 6,716,805 | B1 | 4/2004 | Keenig et al. |
| 6,792,648 | B2 | 9/2004 | Lee |
| 6,797,357 | B2 | 9/2004 | Fereshtehkhou et al. |
| 6,823,558 | B2 | 11/2004 | Lee |
| 6,936,330 | B2 | 8/2005 | Fereshtehkhou et al. |
| 7,013,528 | B2 | 3/2006 | Parker et al. |
| 7,117,556 | B2 | 10/2006 | Grey |
| 7,134,161 | B2 | 11/2006 | Telmo |
| 7,144,173 | B2 | 12/2006 | Policicchio et al. |
| 7,346,428 | B1 | 3/2008 | Huffman et al. |
| D588,770 | S | 3/2009 | Koenig et al. |
| 7,676,877 | B2 | 3/2010 | Policicchio et al. |
| 7,805,795 | B2 | 10/2010 | Stein et al. |
| 8,061,546 | B2 | 11/2011 | Ramsey |
| 8,185,995 | B2 | 5/2012 | Sjoeberg |
| 8,186,898 | B2 | 5/2012 | Bradbury et al. |
| 8,186,989 | B2 | 5/2012 | Yamaura et al. |
| 8,214,960 | B1 | 7/2012 | Rupp |
| 8,230,540 | B1 | 7/2012 | Nelson |
| 8,443,478 | B2 | 5/2013 | West et al. |
| 2004/0045126 | A1 | 3/2004 | Parker et al. |
| 2005/0055792 | A1 | 3/2005 | Kisela et al. |
| 2005/0081888 | A1 | 4/2005 | Pung et al. |
| 2005/0181968 | A1 | 8/2005 | Policicchio et al. |
| 2005/0241086 | A1 | 11/2005 | Damrath et al. |
| 2009/0000051 | A1 | 1/2009 | Rosenzweig et al. |
| 2009/0044351 | A1 | 2/2009 | Menrik et al. |
| 2009/0077761 | A1 | 3/2009 | Kaleta et al. |
| 2010/0287716 | A1 | 11/2010 | Kasper et al. |
| 2013/0333129 | A1 | 12/2013 | Bradbury et al. |
| 2014/0026344 | A1 | 1/2014 | Bradbury et al. |

FOREIGN PATENT DOCUMENTS

| | | | |
|---|---|---|---|
| CN | 201346183 | U | 11/2009 |
| EP | 0825821 | B1 | 4/1996 |
| EP | 1027855 | A2 | 8/2000 |
| EP | 0980224 | B1 | 4/2006 |
| EP | 1330978 | B1 | 2/2008 |
| GB | 583738 | A | 12/1946 |
| GB | 2389035 | B | 5/2006 |
| JP | 09322872 | A | 12/1997 |
| JP | 10113314 | A | 5/1998 |
| JP | 10262886 | A | 10/1998 |
| JP | 2002209809 | A | 7/2002 |
| JP | 2003135348 | A | 5/2003 |
| JP | 2004229953 | A | 8/2004 |

FLOOR CLEANING DEVICE HAVING DISPOSABLE FLOOR SHEETS AND ROTATABLE BEATER BAR AND METHOD OF CLEANING A FLOOR THEREWITH

FIELD OF THE INVENTION

The present invention relates to devices having a floor sheet usable to clean a floor and more particularly to such devices and floor sheets having a rotatable beater bar to assist in cleaning a floor or other hard surface.

BACKGROUND OF THE INVENTION

Cleaning of hard surfaces, such as floors (vinyl, linoleum, tile, cement), countertops, showers, etc. is well known in the art. Cleaning may be accomplished using cellulosic paper towels and non-woven sheets, as are well known in the art. Nonwoven sheets may be made according to commonly assigned U.S. Pat. Nos. 6,936,330 and/or 6,797,357. Cellulosic paper towels may be made according to commonly assigned U.S. Pat. No. 4,191,609 and/or 4,637,859.

Such sheets have been removably attached to manual implements. The implements increase reach, and improve ergonomics. For example, when the hard surface to be cleaned is a floor, the implement allows the user to clean from a standing position, improving comfort over cleaning from a crouched position or on the knees. Manual implements may be made according to commonly assigned U.S. Pat. Nos. 6,305,046 and/or D588,770.

One problem encountered when cleaning floors is that a user can encounter tacky soils, which tend to stick to the floor, and/or encounter a variety of fine soils, such as dust, granular soils, dried food debris, plants, mud, etc. which tend to stick to the floor less.

To improve cleaning of soluble and tacky stains, wetted and wettable floor sheets have been used. Pre-wetted floor sheets include those having APG polymers, as disclosed in commonly assigned U.S. Pat. No. 6,716,805. Wettable floor sheets have been used with the commercially available Swiffer WetJet® device. This device sprays cleaning solution onto the floor from a replaceable reservoir, as described in commonly assigned U.S. Pat. No. 8,186,898. Cleaning solution chemistry and a reservoir therefor may be made according to commonly assigned U.S. Pat. No. 6,386,392. Floor sheets which absorb cleaning solution from the floor may be made according to commonly assigned U.S. Pat. Nos. 5,960,508, 6,101,661 and/or 7,144,173.

But these attempts do not always sufficiently clean the entire range of soils encountered, particularly large particles, such as cereal and chunks of mud from the floor. To overcome the problem of loose, large particle cleaning, rotatable beater bars have been utilized, as disclosed in U.S. Pat. No. 9,783, reissued Jun. 28, 1881; 306,008 issued Sep. 30, 1884; 329,257 issued Oct. 27, 1885; U.S. Pat. No. 4,654,927 issued Apr. 7, 1987; U.S. Pat. No. 7,134,161 issued Nov. 14, 2006. The beater bars in these teachings are driven by the wheels. Particularly, each of these references teaches plural wheels contacting the floor to be cleaned. The wheels drive the beater bar, obviating the need for a separate electric motor. Electric motors add cost and weight to the device. Split beater bars have also been used, as shown in 2005/0055792 and U.S. Pat. No. 7,134,161.

Many mechanical sweepers use beater bars comprising nylon bristles. Bristles may also be used on carpets, where bristles can help loosen hair. Bristles can be prone to hair/lint/thread wrapping which quickly degrades performance. Since mechanical sweepers rely on momentum for pick-up, contaminated bristles reduce cleaning capability. Additionally, bristles can separate, requiring higher rotational speed to reduce bristle separation, and minimize particles passing through the bristles. To further reduce bristle separation, bristles are usually designed to not contact the sweeper housing or other items which may deflect the bristles. The Leifheit sweeper attempts to overcome this problem, using rubber bristles instead nylon. But even these bristles are prone to contamination and bristle to bristle separation.

Powered devices may have a beater bar which is battery or AC line powered to aide in picking up soil. These devices have higher rotational speeds and are more effective than mechanically driven beater bars. But powered devices still have problems with contamination and degradation in performance from lint/hair/thread accumulation.

Devices which also use a disposable sheet to assist in cleaning are known as illustrated by U.S. Pat. No. 7,013,528; 2009/0077761; U.S. Pat. No. 7,346,428 and commonly assigned U.S. Pat. No. 7,676,877. Use of such a disposable sheet can be improved, by adding suction, as disclosed in U.S. Pat. Nos. 7,137,169 and 7,293,322.

But navigation of these prior art devices can be tricky. The plural wheels in the prior art provide for good linear tracking and stability, but compromise maneuverability.

To assist in maneuverability, omni-directional wheels have been proposed, as set forth in US 2008/0018167; 2010/0187779; 2010/0243342; U.S. Pat. Nos. 3,789,947; 4,224,753 and 7,318,628. But these omni-wheels are expensive, leading to plural wheel attempts as shown in US 2009/0077764 and 2011/0126367.

Handles which are not straight have also been proposed to improve ergonomics, as shown in 2011/0219557 and 2009/0223007. But curved handles add complexity in manufacturing, and may not be the correct geometry.

Thus, the problem of cleaning a floor with a device which has a mechanically driven beater bar for large particles and a disposable floor sheet for small particles persists.

SUMMARY OF THE INVENTION

The invention comprises a cleaning system. The system has a foot with a mechanically driven beater bar, and a removable disposable floor sheet. A handle may be pivotally attached to the foot.

DETAILED DESCRIPTION OF THE INVENTION

Figure 1:
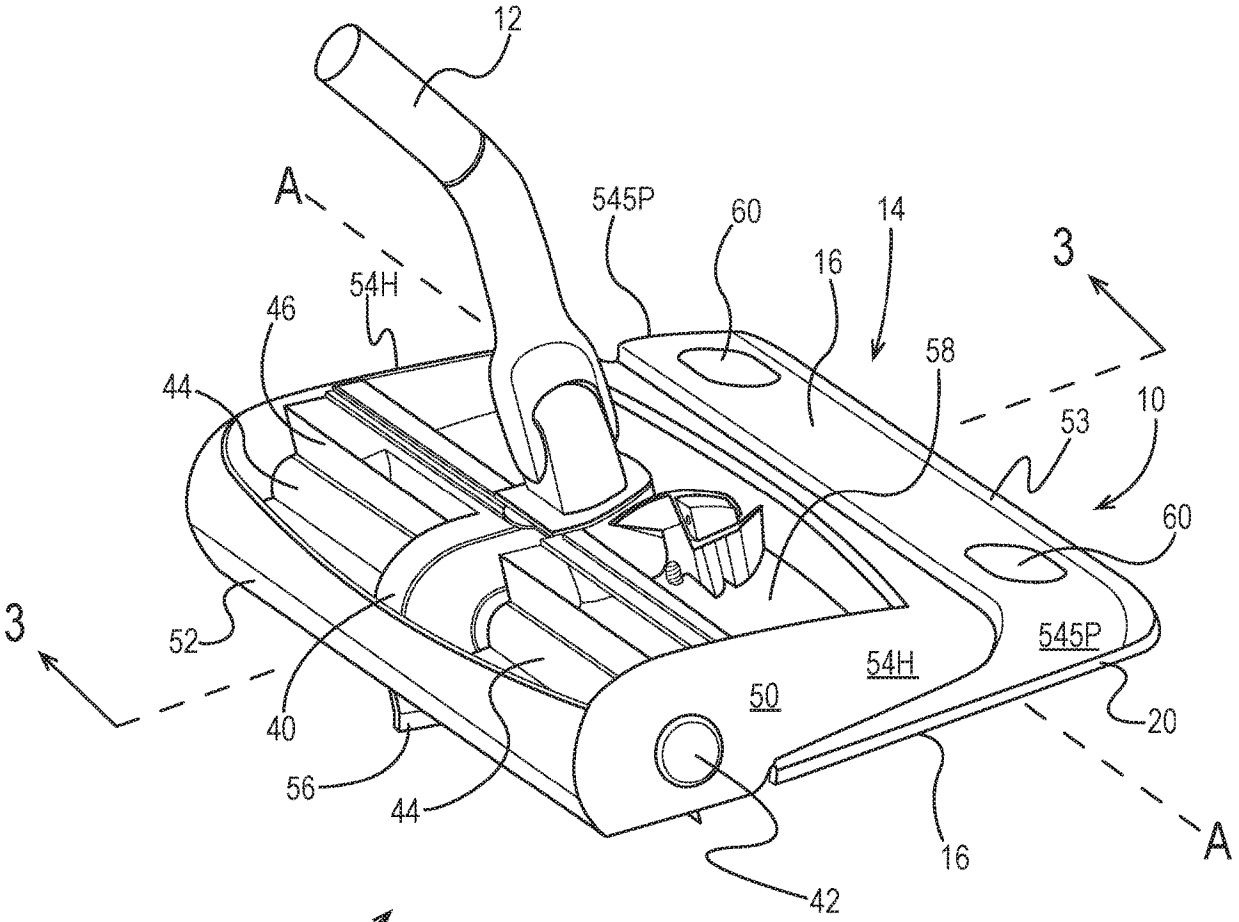
FIG. 1 is a top perspective view of a device of the present invention, with the foot shown partially in cutaway.

Referring to FIG. 1, the invention may comprise a surface cleaning apparatus, (10) with an axially rotatable beater bar (44), to remove debris from the floor. The beater may sweep loose debris into a dirt bin (58), as described in 2010/0287716.

The device (10) may comprise a handle (12) and foot (14) mounted thereto in pivoting or multi-axially swiveling relationship. Alternatively, if a small hand-held device (10) is desired, the handle (12) and foot (14) may be disposed in fixed relationship, so that countertops, showers and similar surfaces may be cleaned. The foot (14) may removably receive a sheet (20) on the bottom thereof, so that such sheet (20) can slidably contact the floor during cleaning.

The device (10) may further comprise an axially rotatable beater bar (44), to remove debris from the floor. The beater bar (44) may be electrically powered, in similar fashion as the steam generator. The beater may sweep loose debris into a dirt bin (58), as described in 2010/0287716.

Referring to FIGS. 1, 2B, 3 and 4 the floor sheet (20) usable with the present invention may comprise a textured nonwoven and more particularly a hydroentangled nonwoven. The nonwoven may comprise a single ply having three layers. The three layers may comprise a layer of carded fibers interposed between two layers of spunbonded fibers. The floor sheet (20) may be made according to commonly assigned U.S. Pat. Nos. 6,561,354; 6,645,604 and/or 2002/0042962.

Optionally, the floor sheet (20) may comprise a laminate construction, particularly if wet cleaning is contemplated with the present invention. The laminate may comprise at least one floor contacting layer and at least one absorbent, reservoir storage layer. A third, dedicated foot (14) contacting layer is optional and can be used for attachment to the device (10). Thus, the floor sheet (20) of the present invention may comprise 1, 2, 3, 4 or more layers.

When a multi-laminate structure is used, the outer floor contacting layer may contain at least about 30% hydrophobic fibers for oil removal and glide on floors. The floor contacting layer may comprise a polyolefinic, discrete apertured nonwoven. This nonwoven may comprise carded, spunbonded, and/or meltblown fibers.

Materials useful in the floor contacting layer may be sufficiently durable to retain integrity during the cleaning process. In addition, when the cleaning pad (20) is used in combination with a solution, the floor contacting layer may be capable of absorbing liquids and soils, and relinquishing those liquids and soils to the storage layer. This transfer ensures the floor contacting layer will be able to remove additional material from the surface being cleaned.

In order to provide desired integrity, materials particularly suitable for the floor contacting layer include synthetics such as polyolefins (e.g., polyethylene and polypropylene), polyesters, polyamides, synthetic cellulosics (e.g., Rayon), and blends thereof. Such synthetic materials can be manufactured using known process such as carded, spunbond, meltblown, airlaid, needle punched and the like. In one embodiment the floor contacting layer may comprise 50 gsm, 80:20 PP/Rayon nonwoven material.

Various methods can be used to form a suitable fibrous web for use in the pad (20) of the present invention. Such a web can be made by nonwoven dry forming techniques, such as airlaying, or alternatively by wet laying, such as on a paper making machine. Other non-woven manufacturing techniques, including but not limited to techniques such as melt blown, spunbonded, needle punched, and hydroentanglement methods can also be used.

In one embodiment, the dry fibers can be an airlaid nonwoven web comprising a combination of natural fibers, staple length synthetic fibers and a latex binder. The dry fibrous web can be about 20 to 80 percent by weight wood pulp fibers, 10 to 60 percent by weight staple length polyester fibers, and about 10 to 25 percent by weight binder. The dry floor sheet (20) can have a basis weight between about 30 and about 1000 grams per square meter.

The floor sheet (20) may be generally rectangular, and sized to removably fit on the sole plate (16) of the device (10). The floor sheet (20) may have two opposed faces, an upper face to receive for attachment to the sole plate of the device (10), and a lower face which contacts and cleans the target surface. The floor sheet (20) can function as a scrubbing layer or have additional materials added for scrubbing.

The floor sheet (20) may comprise a perforate or imperforate film, such as is commonly used for of wetted floor sheets (20) in the art. An imperforate film will inhibit, if not prevent, transmission of steam or liquid therethrough, potentially reducing efficacy of the cleaning system.

The floor sheet (20) may be disposable after a single use. By disposable, it is meant that the pad (20) is discarded after a single use of cleaning at least 5, 10, 15, 20 or more square meters and is not laundered or restored.

Figure 3:
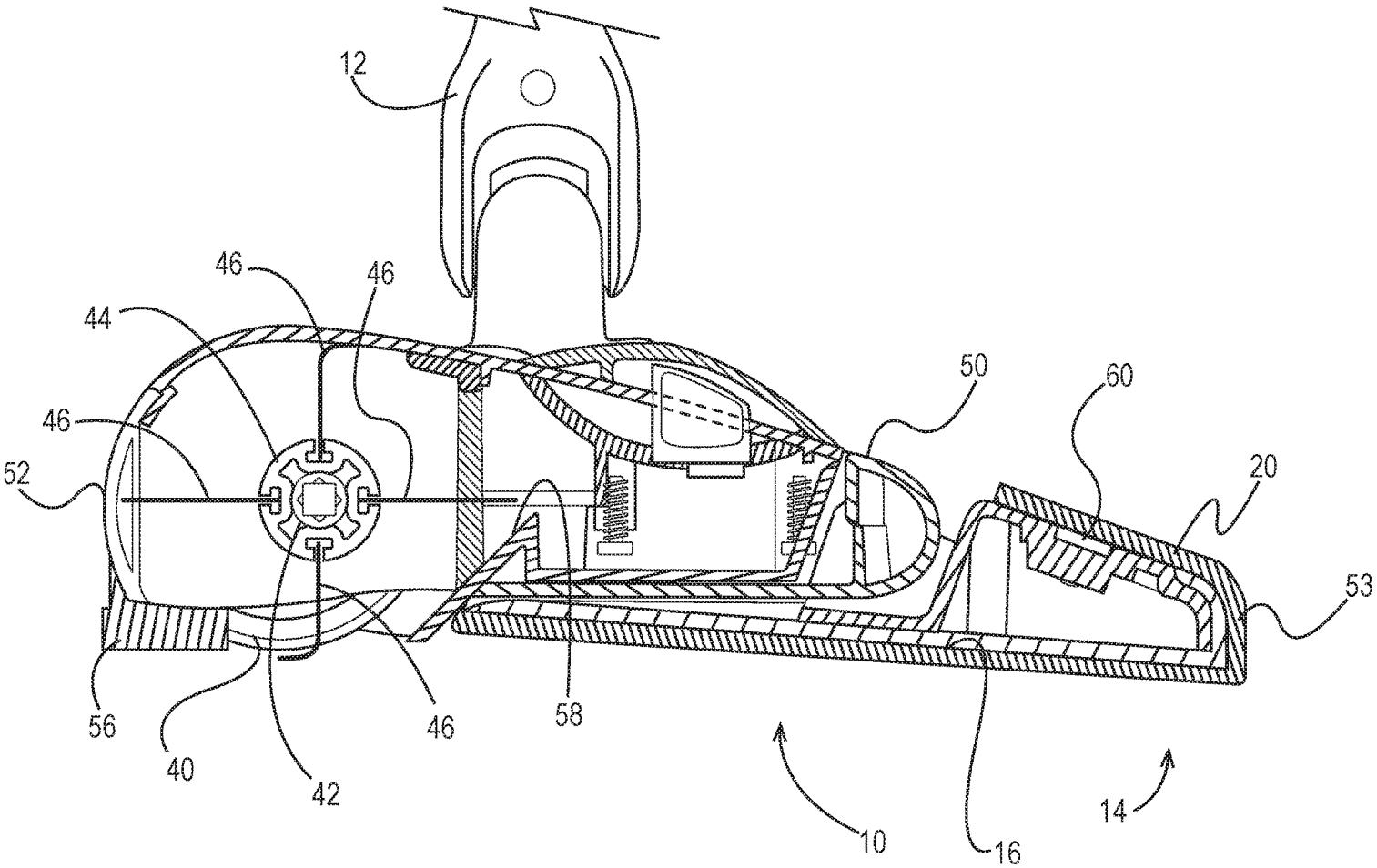
FIG. 3 is a sectional view taken along line 3-3 of FIG. 1, showing interference of the rotating blades of the beater bar with the housing and floor.
Figure 4A:
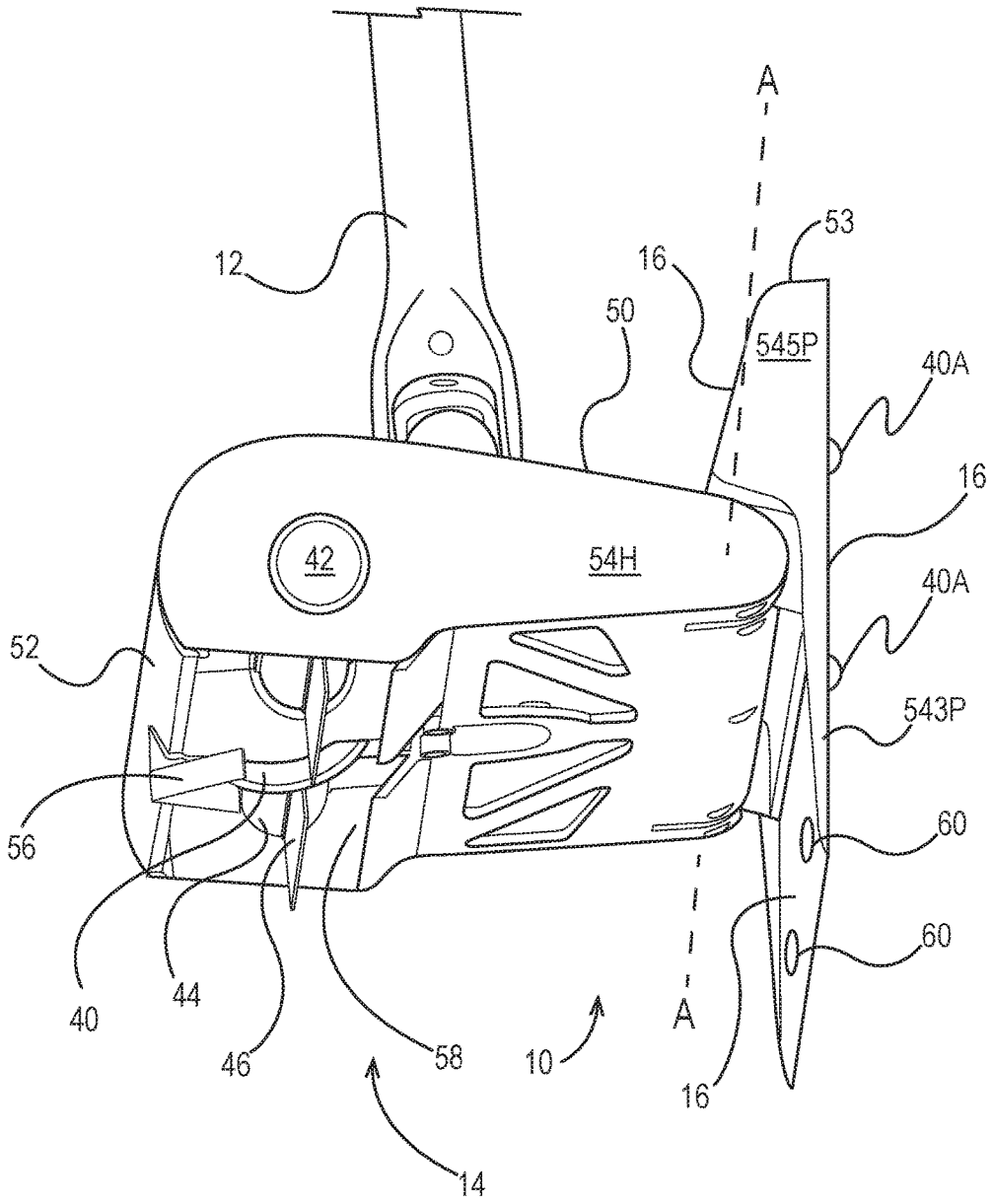
FIG. 4A is a bottom perspective view of a device of the present invention, with the foot pivoted to the open position for removing the dirt bin.
Figure 4B:
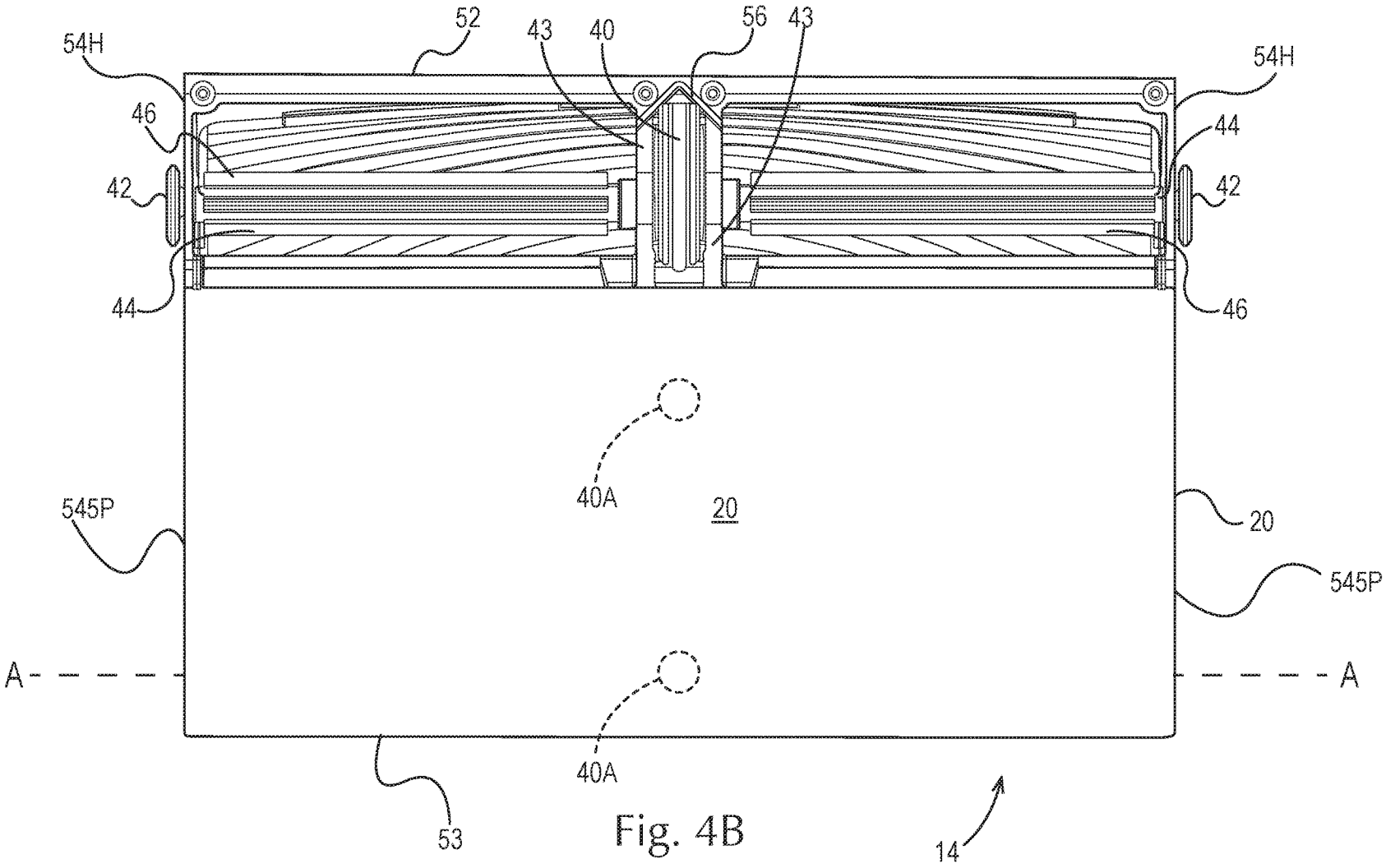
FIG. 4B is a bottom plan view of a device of the present invention.

Referring to FIGS. 1, 3 and 4B, the foot (14) may comprise a footprint large enough to accommodate the floor sheet (20) and beater bar (44). The foot (14) may be generally rectangular, having a front (52), rear (53) and two spaced apart sides of the housing (50) and sole plate (16), respectively, (54H, 54SP). The foot (14) may comprise two symmetrically opposite mirror images, disposed about a longitudinal centerline. The user may generally push the device (10) from front (52) to rear (53), and back, in a series of strokes.

Referring to FIG. 4A, the housing (50) may have a removable or hingedly attached cover to allow access to the beater bars (44) and/or dirt bin (58). Once the axle (42) is removed, collinear with and parallel to the axis, the beater bar (44) may be lifted out through the housing (50) in a direction generally perpendicular to the axis of rotation. This arrangement allows the replacement of a beater bar (44) to occur without the use of tools, such as a screwdriver or pliars. The housing (50) may have a removable cover to allow access to the beater bars (44) and dirt bin (58), or, as shown, the entire housing (50) may hinge to an open position.

Referring to FIGS. 2A-2B and 4A-4B, the beater bar (44) may be parallel to the widthwise direction of the foot (14) and parallel to the axle (42). The beater bar (44) may axially rotate about its axis on the forward stroke. Such rotation will collect large particles in the dirt bin (58). Smaller particles, not collected by the rotation of the beater bar (44), may be captured by the floor sheet (20) which trails the beater bar (44) on a forward stroke. Thus, the distal end blade (46) of the beater bar (44) may be continuous in the axial direction, unlike the bristle type blades (46).

Continuous blades (46), as determined at the distal end thereof, are typically more rigid than bristles of similar size and geometry, creating more resistance upon contact with the floor, dirt bin (58), and/or housing (50). The rotational speed of the blades (46) is a factor to picking up particles. Many sweepers in the art use blades (46) having a clearance to the floor, and therefore miss soils, such as smaller granular soils on hard floors. This situation is exacerbated because a hard floor is typically not compliant or springy like carpeting. Additionally, hard floors, such as ceramic floors with grout lines exacerbate pick-up ability because the blades (46) are unable to reach into cracks and crevices.

The inventors have surprisingly discovered that this conflict could be solved by using a thin, flexible, yet resilient blade (46) to allow the depth to be increased, extending further down onto floor, as described in commonly assigned U.S. Pat. No. 7,676,877. A flexible blade (46) may be less than 1 mm thick or less than 0.5 mm thick. To further increase flexibility, apertures or slits may be added to the blades (46). A continuous blade (46) having apertures/slits allows use of thicker materials, providing a wider base on the portion of the blade (46) proximally joined to the shaft of the beater bar (44), yet impart flexibility and snapping action.

Surprisingly, the inventors found that while conventional materials such as rubber, silicone and the like worked well as blade (46) materials, other polyolefinic materials formed into films such as HDPE, PET, PP and nylon as well as paper, cardboard and paper plus plastic laminates are also effective in providing particle pick-up. These materials have not historically found widespread use blade (46) designs, possibly due to durability concerns (particularly if used on carpet).

On the reverse stroke, drawing the device (10) back towards the user, the beater bar (44) may rotate in reverse, or remain generally stationary, depending upon the force applied to the wheel (40). On the reverse stroke, the floor sheet (20) is leading the beater bar (44), and may become unintentionally loaded with large particles.

Figure 2A:
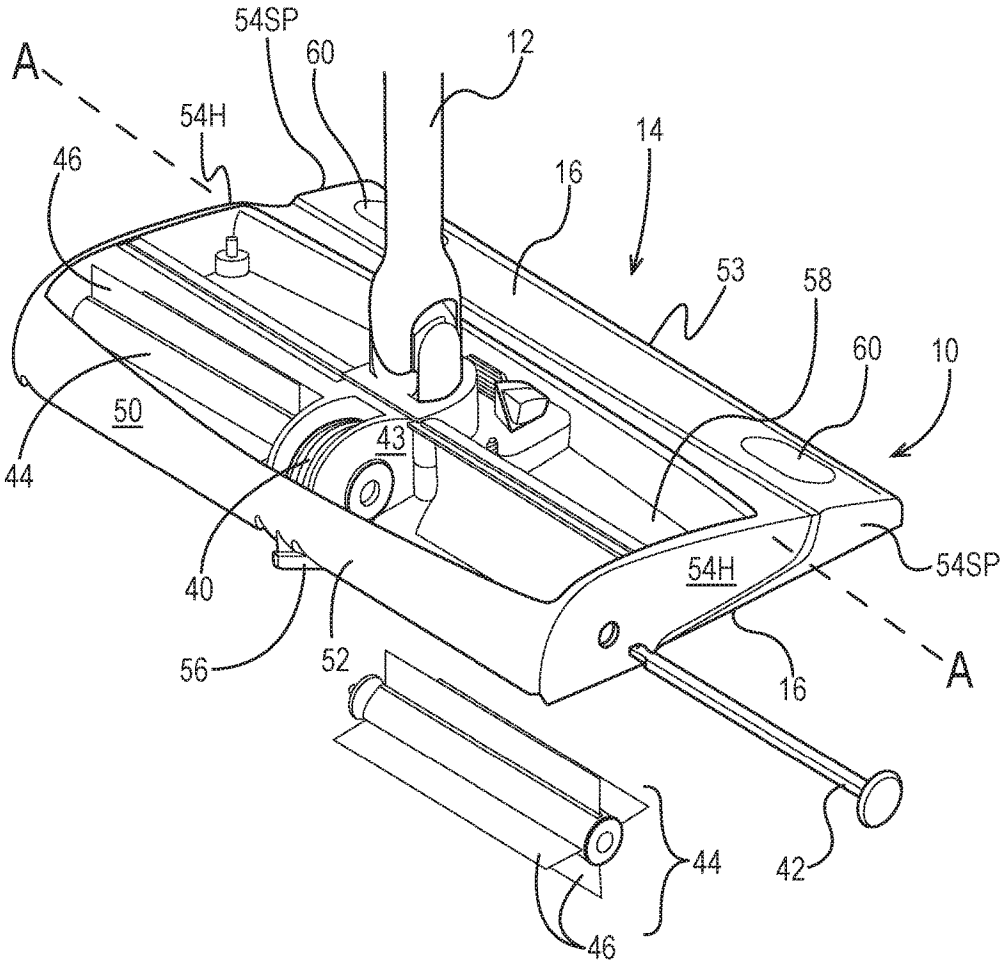
FIG. 2A is a partially exploded perspective view of the device of FIG. 1, shown partially in cutaway and showing the beater bar and axle exploded.
Figure 2B:
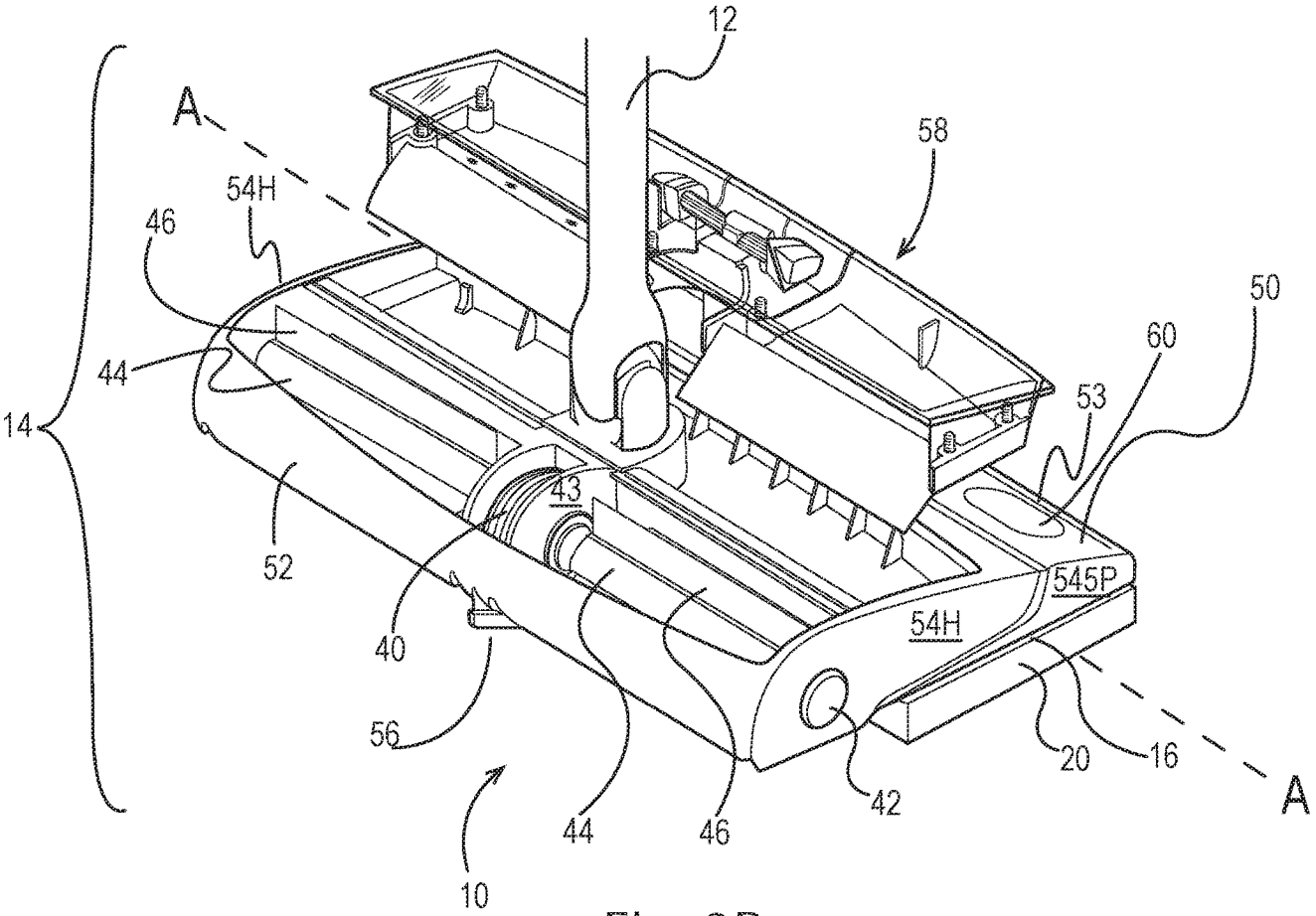
FIG. 2B is a partially exploded perspective view of the device of FIG. 1, shown partially in cutaway and showing the dirt bin exploded.

Referring to FIGS. 2A, 2B and 4A, the beater bar (44) may be contained within a housing (50) for safety. The beater bar (44) may be parallel to the front (52)/rear (53) of the foot (14) and be axially rotatable. The device (10) may comprise two or more co-linear beater bars (44). The two beater bars (44) may be disposed with one on each side of the longitudinal centerline. Each beater bar (44) may be disposed on and rotate about an axle (42). Each axle (42) may extend from the respective side (54H) of the housing (50) to a trunnion (43) juxtaposed with the longitudinal centerline. The axles (42) may be locked in place by protrusions in the axles (42) which fit into complementary detents in the trunnions (43). The beater bar (44) thus may be easily and conveniently removed and replaced, without having to undo belts, screws, etc.

The beater bar (44) may be made of cardboard, plastic or other inexpensive material. This arrangement provides the advantage that different beater bars (44) may be used, and the user may select a particular beater bar (44) most suitable for a particular cleaning task. Or the beater bar (44) may be discarded and easily replaced when soiled or its useful life is depleted. Alternatively the core of the beater bar (44) may be retained and only the blades (46) replaced as necessary.

Referring to FIGS. 1-2B, the beater bar (44) may have one or more blades (46). The blades (46) may be axially parallel, as shown, spiral wound, chevron shaped, etc., as are known in the art. The blades (46) may be resilient, so that they can deform during rotation. The blades (46) may have a radial length sufficient to cause interference with the floor, dirt bin (58) and/or the inside of the housing (50).

The blades (46) may comprise bristles, fins, panels, mesh, etc. The blades (46) may extend radially outward from the axle (42) or diagonally outward from the axle (42).

For axially parallel polyethylene blades (46) having a radial dimension [straight or diagonally outward] of 35 to 65 mm and particularly 50 mm, and a thickness of 0.2 to 1 mm and particularly 0.6 mm, an interference with the housing (50), dirt bin (58) and/or floor of 0.5 to 6 mm, 2 to 4 mm and particularly 3 mm is generally suitable, particularly for blades (46) having a Shore A hardness of 30 to 50, particularly 40. By interfering with the floor, housing (50) and/or edge of the dirt bin (58), the blade (46) will deflect, and rapidly uncoil, acting as a spring when free of the interference, flicking debris into the dirt bin (58).

The blades (46) may be tapered to be thicker at the proximal end and thinner at the distal end. This arrangement provides the benefit of strength where the bending moment is greatest and flexibility near the distal end. Alternatively or additionally, the blades (46) may have holes therethough to increase flexibility, particularly for a blade (46) being continuous at the distal end thereof. For a polyester film material blade (46) having a thickness of 0.5 mm, five to 10 holes having a diameter of 2 to 5 mm and generally equally spaced apart on a blade (46) 100 mm long by 15 mm radial dimension may be suitable.

Referring to FIGS. 2B, 3 and 4A, the foot (14) may comprise a dirt bin (58). At the end of the cleaning task, or when filled, the dirt bin (58) may be removed from the foot (14) through a cover in the housing (50) or by pivoting the housing (50) to an open position. If desired, the dirt bin (58) may comprise part of the housing (50).

Referring to FIGS. 4A and 4B, the foot (14) may comprise a single wheel (40). The single wheel (40) may be disposed on the longitudinal centerline of the foot (14). The wheel (40) may be mounted towards the front (52) or rear (53) of the foot (14).

As used herein, a wheel (40) is a rolling element which rotates about a single axle (42), and more particular only rotates about a single axis. The axis and axle (42) may be parallel to the width direction of the foot (14), and perpendicular to the longitudinal centerline of the foot (14). A wheel (40) does not rotate about multiple axes.

A single wheel (40) is considered to be one wheel (40), and not more. But a single wheel (40) may comprise two, or more wheels (40), in sufficiently close relationship to act as a single wheel (40). Plural wheels (40) may act as, and be considered a single wheel (40) and have a width between centerlines of the wheels (40) less than 10, 5, 3, or 1 mm. Only wheels (40) having a diameter and placement sufficient to allow rotation on the floor are considered for purposes herein.

A castor or roller ball (40A), both being generally spherical, are not considered to be a wheel (40) for purposes of the claimed invention. Prophetically a castor or roller ball (40A) would not impede the maneuverability of the device (10) having a single wheel (40) as a castor or roller ball (40A) can rotate about plural axes.

The wheel (40) may have a diameter ranging from 18 to 63 and particularly 43 mm. The wheel (40) may be relatively narrow at the circumference, to improve maneuverability. The wheel (40) may have a rubber periphery, to provide traction sufficient to drive each beater bar (44). The beater bar(s) (44) may be driven in a 1:1 ratio with the wheel (40) or may be geared to be rotationally driven faster than the wheel (40), at a ratio ranging to 3, 4, 5 or 6:1.

If desired, the single wheel (40) may be stepped, to allow the wheel (40) to sit deeper into grout lines and other irregularities in the surface. This arrangement allows the beater bar (44) and floor sheet (20) to better contact the floor or other target surface. If desired, an O-ring may be circumferentially placed around the circumference of the wheel (40) to reduce contact area and provide a step for the wheel (40).

Referring to FIGS. 2A, 2B, 4A and 4*b*, the foot (14) may further comprise a plow (56). The plow (56) may be chevron-shaped, arcuate, diagonally oriented with respect to the front (52) of the device, etc. Optionally, the wheel (40) may partially nest within the plow (56), as shown. The plow (56) may be disposed on the longitudinal centerline, as shown.

The plow (56) may intercept debris on the floor and divert such debris away from the wheel (40). Particularly, the plow (56) may divert debris to a beater bar (44) or to both beater bars (44), so that the debris can be picked up thereby and directed to the dirt bin (58).

Referring to FIGS. 1-4B, the wheel (40) may be juxtaposed with the front (52) of the device (10). The wheel (40) may rotate about an axis parallel to the axis of the beater bar (44). The axis of the wheel (40) may be disposed away from the front (52) of the device (10) a distance of the wheel (40) radius plus 5, 10 or 15%, or a distance of the wheel (40) radius plus 3, 4, 5, 6, or 10 mm.

In a degenerate case the axis of the wheel (40) may be collinear with the axis of the beater bar (44). In a further degenerate case, the wheel (40) may be mounted intermediate the trunions (43) to which the axles (42) are mounted.

The foot (14) may further comprise a universal joint, ball and socket joint, etc. or portion thereof to pivotally receive a handle (12). Optionally and if small enough, the foot (14) may be used without a handle (12).

If desired, the handle (12) of the device (10) may be curvilinear. Particularly, the handle (12) may be curved at the bottom quartile of its length, i.e. the quartile closest to the foot (14). The bend may be 20 to 40 degrees, particularly 30 degrees, concave towards the floor when the universal joint is in a vertical position.

Optionally, the device (10) may further comprise a vacuum, to remove debris from the floor. The vacuum may be fan powered, and provide for delivery of lose debris to a dirt bin (58). The dirt bin (58) may be mounted on the handle (12) of the device (10), as disclosed in U.S. Pat. No. 7,137,169. If a vacuum system is used, the vacuum system may have a pivoting nozzle to allow access to sheet grippers (60), as disclosed in U.S. Pat. No. 7,293,322. The sheet grippers (60) may comprise resilient fingers as shown in commonly assigned U.S. Pat. Nos. 6,305,046, 6,484,346 and 6,651,290. The floor sheet (20) may be attached using the aforementioned grippers, hook and loop fasteners, adhesive, etc.

Pre-moistened pads (20) used in the system of the present invention may be particularly advantageous in that they are always ready for use, and simple to use without special dosing. The user does not have to worry about applying too much cleaning solution, leading to waste, or too little cleaning solution to be efficacious. A pre-moistened pad (20) may be made according to the teachings of commonly assigned U.S. Pat. No. 6,716,805.

In yet another embodiment, the device (10) may spray the cleaning solution onto the floor or other target surface. This arrangement provides the benefit that the user can see where the cleaning solution is being applied, with it being blocked under the floor sheet (20). The cleaning solution may be any of the liquid solutions described above, aqueous or otherwise.

The sprayer may be a pump system, as described with respect to commonly assigned U.S. Pat. No. 8,186,898, or a gravity feed system, either permanently/removably attached to the device (10) or a part thereof. Or a separate aerosol or trigger pump sprayer may be utilized, as are well known in the art.

If a spray system is selected, such a system may allow for use with reusable pads (20), such as the microfiber pads (20) used with commercially available steam device (10). But the reusable pads (20) have the disadvantages disclosed herein. Thus a spray system may be advantageously used with a single-use floor sheet (20), which is discarded after one cleaning event. If spray is used it will be advantageous to use dry absorbent pads (20) such those described and referenced herein by U.S. Pat. No. 6,716,805 B1, U.S. Pat. No. 7,420,656 B2, U.S. Pat. No. 7,163,349, U.S. Pat. No. 6,101,661, and U.S. Pat. No. 7,144,173.

Figure 5:
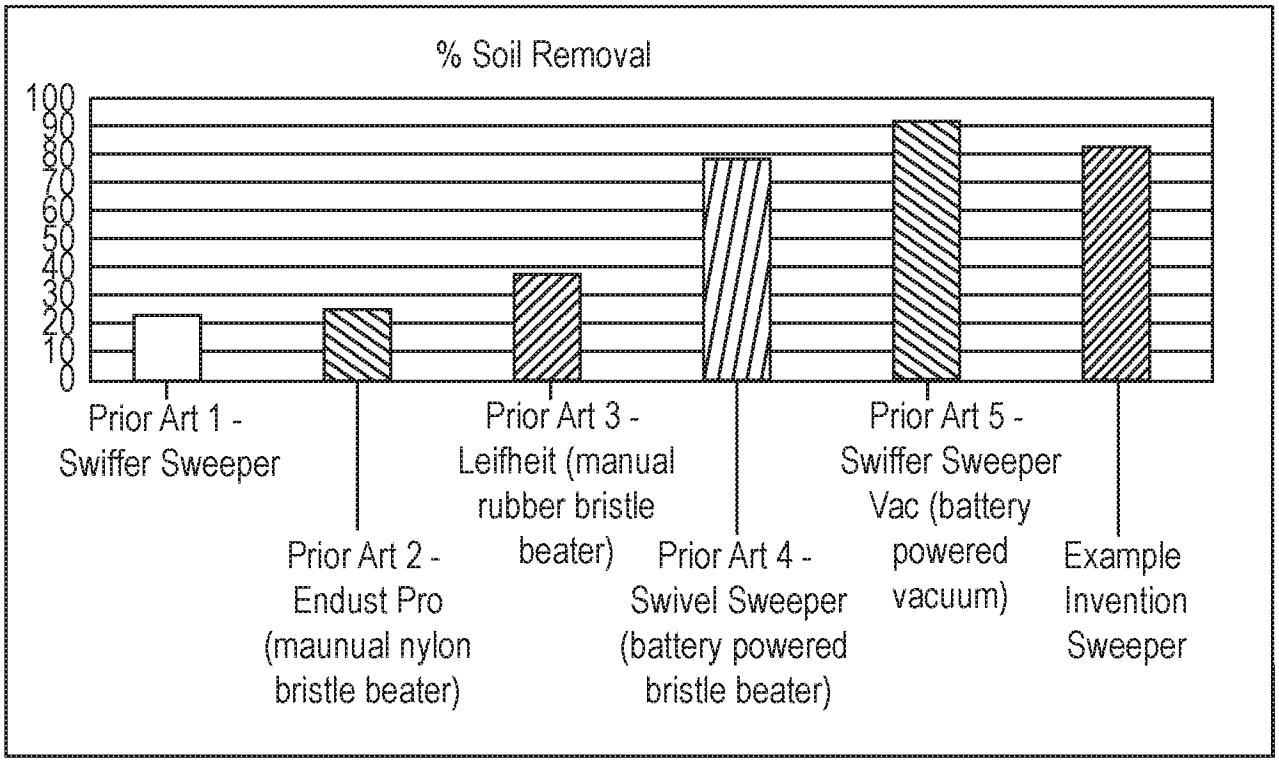
FIG. 5 is a graphical representation of the cleaning performance of five devices according to the prior art and one illustrative, non-limiting embodiment of the present invention.

Referring to FIG. 5, five commercially available devices according to the prior art and one, exemplary, non-limiting embodiment of the present invention were tested for cleaning performance.

The five devices selected for controls in this test are believed to cover a variety of commercially available devices:

1. Swiffer Sweeper® sold by the instant assignee and having a dry floor sheet
2. Endust Pro device having a manually driven bristle beater bar
3. Leifheit device having a manually driven rubber bristle beater bar
4. Swivel Sweeper having four rechargeable battery powered spiral bristle beater bars
5. Swiffer SweeperVac® sold by the instant assignee and having a dry floor sheet and vacuum
6. Present invention having a mechanically driven beater bar with blades and a dry floor sheet.

Controls 4 and 5 are powered, using rotatable beater bars and vacuum assist to improve cleaning performance. Controls 2 and 3 have manually driven beater bars, similar to the present invention. Control 1 uses a floor sheet, similar to the present invention.

The aforementioned devices were tested, using a ceramic floor having rectangular dimensions of 2.1×1.5 meters with 7 mm wide by 5 mm deep grout lines. Three sides of the test floor had baseboards to simulate in-home use.

For each test six grams of an eight component soil admixture comprising fine dust, granular soil, particulate soil, large particles, plant matter and hair. The soil was evenly spread across the test floor.

Each sample device was weighed, then swept across the floor using a saw-tooth pattern and around the perimeter, parallel to the edges. The devices were reweighed to determine how many grams of soil were collected. N=5 samples were run for each test. The results are tabulated in FIG. 5.

FIG. 5 shows that Control Device 1, having only a floor sheet, cleaned the least percentage of soil from the test floor. Control Device 2, having only a manually powered bristle beater bar cleaned only a slightly greater, but similar, percentage of soil from the test floor. Control Device 3, having only a manually powered rubber bristle beater bar cleaned only a slightly greater, percentage than Control 2.

In contrast, the device (10) according to the present invention, also having a manually powered beater bar (44), unexpectedly cleaned more than double the percentage of soil compared to manually powered Controls 2 and 3. Such improved results were unexpected, as each of Controls 2 and 3 also utilize a manually powered beater bar.

Comparing Controls 4 and 5, both are battery powered. Control 4 uses a beater bar. It can be seen that the device (10) according to the present invention unexpectedly even cleans slightly better than this battery powered control.

Control 5 utilizes a battery powered vacuum, in place of the battery powered beater bar. Again, the performance of the device (10) according to the present invention is second only to and only slightly less than Control 5. Such performance according to the present invention is unexpected due to the assist provided by the battery power.

FIG. 5 shows the data can be clustered into two groups. Controls 1-3 show a particular level of cleaning performance for non-powered devices. Controls 4-5 and the present invention show a significantly better level of cleaning performance.

Such difference is unexpected. One of skill would predict that the manually powered device (10) would have a performance comparable to the manually powered devices of Controls 1-3. Instead, the device (10) of the present invention unexpectedly has performance comparable to the much better electrically powered Controls 4-5.

Looking at FIG. 6, one of skill would even further find the cleaning performance of the present invention to be more unexpected. Control 1 provided 23% pickup using a floor sheet. Control 3 provided 39% pickup using a manually powered beater bar. Combining these features of Controls 1 and 3, one of skill would predict a pickup of approximately 62% (23%+39%).

Unexpectedly the present invention provides 85% pickup. This improvement in performance is significantly greater (85−62=23%) than would be expected by simply looking at combining the Controls.

If one were to use the Control 2, having a 27% pickup, in place of Control 3 (39% pickup) the difference in performance is even greater. Under this scenario, one of skill might predict a device (10) according the invention might have 50% pickup (23%+27%). Such a value is 35% less than would be predicted (85%−50%) using Control 2. Without being bound by theory, one could surmise the improved maneuverability of the present invention is a factor in the unexpectedly good cleaning performance of the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

Except as otherwise noted, the articles "a," "an," and "the" mean "one or more." All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A foot for a floor cleaning device and being able to receive a handle pivotally attached thereto, said foot being movable on a floor and comprising:

a housing having a front side, a rear side longitudinally opposed thereto, a top and a bottom opposed thereto and two opposed sides connecting said front side and said rear side, a sole plate juxtaposed with the bottom of the housing and being able to removably receive a disposable floor sheet thereon, at least one wheel disposed in said foot and rotating in response to movement of said foot on a floor, an axially rotatable beater bar with at least one blade extending radially outwardly therefrom, said beater bar rotating in response to rotation of said at least one wheel; and a dirt bin disposed in said housing and in communication with said beater bar to receive debris therefrom and being removable through the top of said housing, said dirt bin having an inclined ramp fixedly mounted thereto and juxtaposed with said beater bar.

2. A foot according to claim 1 further comprising a castor and/or roller ball juxtaposed with the bottom of said foot, said castor and/or roller ball rotatably contacting a floor when said foot is placed thereon.

3. A foot according to claim 1 wherein said beater bar and said at least one wheel are coaxial.

4. A foot according to claim 3 having a longitudinal centerline, said axis of said at least one wheel being perpendicular to said longitudinal centerline.

5. A foot according to claim 1 having a longitudinal centerline, said at least one wheel being disposed on said longitudinal centerline.

6. A device for cleaning a hard surface, said device comprising:

a foot, said foot being connectable to a handle, said foot being movable on a hard surface, said foot having a front, a rear longitudinally opposed thereto, and two opposed sides connecting said front and said rear, said foot comprising a sole plate for removably attaching a disposable sheet thereto;

an axially rotatable beater bar disposed in front of said sole plate, said beater bar rotating in response to movement of said foot on said hard surface, said foot further comprising a plurality of wheels, at least one of said wheels being operably connected to said beater bar to cause rotation thereof when at least one of said wheels rolls on a hard surface, said plurality of wheels having a width of less than 10 mm between centerlines of said wheels.

7. A device according to claim 6 wherein said at least one wheel being operably connected to said beater bar has a diameter ranging from 18 to 63 mm.

8. A device according to claim 7 wherein said beater bar is gear driven, so that said beater bar is driven faster than said at least one said wheel.

9. A device according to claim 8 wherein said foot has a housing with said beater bar therein, wherein said beater bar is gear driven to be rotationally driven faster than said at least one said wheel.

10. A device according to claim 7 wherein said at least one wheel is stepped.

11. A device according to claim 10 wherein said at least one wheel is rotatably disposed on an axle and said axle is removable from said device independent of said beater bar.

12. A device for cleaning a floor, said device comprising a foot, said foot being movable on a floor, said foot having a front side, a rear side longitudinally opposed thereto, and two opposed sides connecting said front side and said rear side, a sole plate for removably receiving a disposable floor sheet thereon, at least one wheel disposed in said foot and rotating in response to movement of said foot on a floor, two axially rotatable beater bars juxtaposed with the front side of said device and operably connected to said wheel, one said beater bar being disposed on each side of said wheel, whereby said beater bars rotate in response to rotation of said wheel on a floor, each said beater bar being removable from said foot independently of said other beater bar, at least one castor and/or roller ball mounted on said sole plate for contact with a floor and an elongate handle pivotally connected to said foot.

13. A device according to claim 12 having a housing to contain said beater bar and said at least one wheel therein, wherein said beater bar rotates about an elongate axle, said axle being removable from said housing in a direction parallel to said axle.

14. A device according to claim 12 wherein said at least one wheel is disposed symmetrically intermediate said beater bars.

15. A device according to claim 12 having a longitudinal centerline, wherein each said beater bar is sleeved over a respective axle and being removable therefrom in a direction parallel to said axle and outwardly from said longitudinal centerline.

16. A device according to claim 15 wherein said at least one wheel is mounted intermediate two trunnions, each said trunnion supporting one said axle.

17. A device according to claim 12 wherein said at least one wheel and said beater bars are juxtaposed with the front side of said device.

18. A device according to claim 17 wherein each of said at least one wheels has a width of less than 10 mm.

19. A device according to claim 12 wherein said foot further comprises a dirt bin accessible from the top of said device.

20. A device according to claim 19 further comprising a vacuum for depositing debris into said dirt bin.

* * * * *